US005854628A

United States Patent [19]

Nakagawa

[11] Patent Number: 5,854,628

[45] Date of Patent: Dec. 29, 1998

[54] WINDOW DISPLAY PROCESSING METHOD AND APPARATUS

[75] Inventor: Yukihiro Nakagawa, Kawasaki, Japan

[73] Assignee: Fujitsu Limited, Kawasaki, Japan

[21] Appl. No.: 527,091

[22] Filed: Sep. 12, 1995

[30] Foreign Application Priority Data

Dec. 27, 1994 [JP] Japan ..... 6-325757

[51] Int. Cl.[6] ..... G09G 5/14

[52] U.S. Cl. ..... 345/340; 345/344; 345/508

[58] Field of Search ..... 345/119, 120, 345/344, 340, 343, 507, 508; 395/158, 157, 164, 152

[56] References Cited

U.S. PATENT DOCUMENTS

| | | | |
|---|---|---|---|
| 4,769,762 | 9/1988 | Tsujido | 345/120 |
| 4,890,257 | 12/1989 | Anthias et al. | 345/119 |
| 4,954,819 | 9/1990 | Watkins | 345/120 |
| 5,061,919 | 10/1991 | Watkins | 345/119 |
| 5,241,656 | 8/1993 | Loucks et al. | 345/120 |
| 5,475,812 | 12/1995 | Corona et al. | 345/120 |
| 5,588,106 | 12/1996 | Habata | 395/340 |

FOREIGN PATENT DOCUMENTS

| | | |
|---|---|---|
| 0 212 563 | 3/1987 | European Pat. Off. . |
| 0 280 582 | 8/1988 | European Pat. Off. . |
| 4-225395 | 8/1992 | Japan . |
| 2 147772 | 5/1985 | United Kingdom . |
| 2 191917 | 12/1987 | United Kingdom . |
| 2 224622 | 5/1990 | United Kingdom . |

*Primary Examiner*—Amare Mengistu
*Attorney, Agent, or Firm*—Staas & Halsey

[57] ABSTRACT

Two window ID plane storages corresponding to two frame buffers store window ID planes consisting of window ID's as window ID information for individual pixels to identify a window pixel by pixel of each frame buffer. An overlapping table storage stores an overlapping table which describes the overlapping relation among individual windows over those frame buffers. A switching section selects a window to be displayed and switches between the frame buffers pixel by pixel, in accordance with the two window ID planes and the contents of the overlapping table. The switching section then supplies the content of the selected frame buffer to a monitor.

10 Claims, 14 Drawing Sheets

FIG. 8

WINDOW ID <B>

| WINDOW ID <A> | 0 | 1 | 2 | 3 | 4 | 5 | 6 | 7 | 8 | 9 | 10 | 11 | 12 | · · · |
|---|---|---|---|---|---|---|---|---|---|---|---|---|---|---|
| 0 | X | B | B | B | B | B | B | B | B | B | B | B | B | |
| 1 | A | X | A | X | X | X | X | X | X | X | X | X | X | |
| 2 | A | B | X | X | X | X | X | X | X | X | X | X | X | |
| 3 | A | X | X | B | X | X | X | X | X | X | X | X | X | |
| 4 | A | X | X | X | X | X | X | X | X | X | X | X | X | |
| 5 | A | X | X | X | X | X | X | X | X | X | X | X | X | |
| 6 | A | X | X | X | X | X | X | X | X | X | X | X | X | |
| 7 | A | X | X | X | X | X | X | X | X | X | X | X | X | |
| 8 | A | X | X | X | X | X | X | X | X | X | X | X | X | |
| 9 | A | X | X | X | X | X | X | X | X | X | X | X | X | |
| 10 | A | X | X | X | X | X | X | X | X | X | X | X | X | |
| · · · | | | | | | | | | | | | | | |

A : DISPLAY FRAME BUFFER <A>
B : DISPLAY FRAME BUFFER <B>
X : EITHER FRAME BUFFER <A> OR <B> MAY BE DISPLAYED

FIG. 12

| WINDOW ID <A> \ WINDOW ID <B> | 0 | 1 | 2 | 3 | 4 | 5 | 6 | 7 | 8 | 9 | 10 | ··· | 15 |
|---|---|---|---|---|---|---|---|---|---|---|---|---|---|
| 0 | 1 | 0 | 0 | 0 | 0 | 0 | 0 | 0 | 0 | 0 | 0 | | 0 |
| 1 | 1 | 1 | 0 | 1 | 0 | 1 | 1 | 1 | 1 | 1 | 1 | | 1 |
| 2 | 1 | 1 | 1 | 1 | 0 | 1 | 1 | 1 | 1 | 1 | 1 | | 1 |
| 3 | 1 | 0 | 0 | 0 | 0 | 1 | 1 | 1 | 1 | 1 | 1 | | 1 |
| 4 | 1 | 1 | 1 | 1 | 1 | 1 | 1 | 1 | 1 | 1 | 1 | | 1 |
| 5 | 1 | 0 | 0 | 0 | 0 | 1 | 1 | 1 | 1 | 1 | 1 | | 1 |
| 6 | 1 | 0 | 0 | 0 | 0 | 0 | 1 | 1 | 1 | 1 | 1 | | 1 |
| 7 | 1 | 0 | 0 | 0 | 0 | 0 | 0 | 1 | 1 | 1 | 1 | | 1 |
| 8 | 1 | 0 | 0 | 0 | 0 | 0 | 0 | 0 | 1 | 1 | 1 | | 1 |
| 9 | 1 | 0 | 0 | 0 | 0 | 0 | 0 | 0 | 0 | 1 | 1 | | 1 |
| ⋮ | ⋮ | | | | | | | | | | | | ⋮ |
| 15 | 1 | 0 | 0 | 0 | 0 | 0 | 0 | 0 | 0 | 0 | 0 | | 1 |

1 : DISPLAY FRAME BUFFER <A>
0 : DISPLAY FRAME BUFFER <B>

FIG. 14

| WINDOW ID <A> \ WINDOW ID <B> | 0 | 1 | 2 | 3 | 4 | 5 | 6 | 7 | 8 | 9 | 10 | ··· | 15 |
|---|---|---|---|---|---|---|---|---|---|---|---|---|---|
| 0 | 1 | 0 | 0 | 0 | 0 | 0 | 0 | 0 | 0 | 0 | 0 | | 0 |
| 1 | 1 | 1 | 1 | 1 | 1 | 1 | 1 | 1 | 1 | 1 | 1 | | 1 |
| 2 | 1 | 0 | 1 | 1 | 0 | 1 | 1 | 1 | 1 | 1 | 1 | | 1 |
| 3 | 1 | 0 | 0 | 0 | 0 | 1 | 1 | 1 | 1 | 1 | 1 | | 1 |
| 4 | 1 | 0 | 1 | 1 | 1 | 1 | 1 | 1 | 1 | 1 | 1 | | 1 |
| 5 | 1 | 0 | 0 | 0 | 0 | 1 | 1 | 1 | 1 | 1 | 1 | | 1 |
| 6 | 1 | 0 | 0 | 0 | 0 | 0 | 1 | 1 | 1 | 1 | 1 | | 1 |
| 7 | 1 | 0 | 0 | 0 | 0 | 0 | 0 | 1 | 1 | 1 | 1 | | 1 |
| 8 | 1 | 0 | 0 | 0 | 0 | 0 | 0 | 0 | 1 | 1 | 1 | | 1 |
| 9 | 1 | 0 | 0 | 0 | 0 | 0 | 0 | 0 | 0 | 1 | 1 | | 1 |
| ⋮ | | | | | | | | | | | | | |
| 15 | 1 | 0 | 0 | 0 | 0 | 0 | 0 | 0 | 0 | 0 | 0 | | 1 |

1 : DISPLAY FRAME BUFFER <A>
0 : DISPLAY FRAME BUFFER <B>

FIG. 16

| WINDOW ID <A> \ WINDOW ID <B> | 0 | 1 | 2 | 3 | 4 | 5 | 6 | 7 | 8 | 9 | 10 | ··· | 15 |
|---|---|---|---|---|---|---|---|---|---|---|---|---|---|
| 0 | 1 | 0 | 0 | 0 | 0 | 0 | 0 | 0 | 0 | 0 | 0 | | 0 |
| 1 | 1 | 1 | 1 | 1 | 1 | 1 | 1 | 1 | 1 | 1 | 1 | | 1 |
| 2 | 1 | 0 | 1 | 1 | 0 | 1 | 1 | 1 | 1 | 1 | 1 | | 1 |
| 3 | 1 | 0 | 0 | 0 | 0 | 1 | 1 | 1 | 1 | 1 | 1 | | 1 |
| 4 | 1 | 0 | 1 | 1 | 1 | 1 | 1 | 1 | 1 | 1 | 1 | | 1 |
| 5 | 1 | 0 | 0 | 0 | 0 | 1 | 1 | 1 | 1 | 1 | 1 | | 1 |
| 6 | 1 | 0 | 0 | 0 | 0 | 0 | 1 | 1 | 1 | 1 | 1 | | 1 |
| 7 | 1 | 0 | 0 | 0 | 0 | 0 | 0 | 1 | 1 | 1 | 1 | | 1 |
| 8 | 1 | 0 | 0 | 0 | 0 | 0 | 0 | 0 | 1 | 1 | 1 | | 1 |
| 9 | 1 | 0 | 0 | 0 | 0 | 0 | 0 | 0 | 0 | 1 | 1 | | 1 |
| ⋮ | | | | | | | | | | | | | ⋮ |
| 15 | 1 | 0 | 0 | 0 | 0 | 0 | 0 | 0 | 0 | 0 | 0 | | 1 |

1 : DISPLAY FRAME BUFFER <A>
0 : DISPLAY FRAME BUFFER <B>

WINDOW DISPLAY PROCESSING METHOD AND APPARATUS

BACKGROUND OF THE INVENTION

1. Field of the Invention

The present invention relates to a display device for displaying images like computer graphics (CG), and, more particularly, to a window display processing method and apparatus for efficiently executing window display processing using a plurality of frame buffers.

2. Description of the Related Art

Recently, as one technology to display multimedia images, such as a document-like text image, a video image picked up by a video camera and a computer graphics (CG) image, on a common display, a window system (multiwindow system) has been proposed in which one or more windows corresponding to individual image media are provided on a frame buffer and are placed one on another, as needed, on such a common display.

Conventionally, the practical usage of such a window system requires that the image of only a partial area produced by overlapped windows, e.g., an "L"-shaped area, should be displayed. This task requires a fast clipping process to clip an arbitrary area of an image.

One example of the conventional window display will be described with reference to FIG. 1. A processor 1 draws the image of an arbitrary window on a frame buffer 2. The content of the frame buffer 2 is subjected to D/A (Digital-to-Analog) conversion to be displayed on the screen of a monitor 3. In FIG. 1, three windows 1, 2 and 3 drawn on a single frame buffer (frame buffer 2) are displayed on the screen of the monitor 3. FIG. 1 shows that the window 1 hides a part of the area of the window 2 with an active window 1 located in front of the window 2. A memory 4 is a main memory which is to be accessed by the processor 1 in association with an image drawing operation or the like.

When the window 2 is selected with a mouse 5 or the like in the state in FIG. 1, the window 2 becomes an active window as shown in FIG. 2 and comes in front of the window 1 of the screen of the monitor 3. The entire area of the active window 2 is displayed, with a part of the window 1 being covered with the window 2.

A double buffer system is a popular scheme to display CG images or the like, which are created by a computer, and uses a pair of frame buffers. One image is drawn on one frame buffer, while the content of the other frame buffer which has already been drawn is displayed to improve the apparent response, thus ensuring continuous display of a plurality of CG images like an animation.

FIG. 3 shows one example of a window display processing using the double buffer system. In this case, a processor (not shown in FIG. 3) draws a window 1 and a window 2, which do not undergo the double buffering display, on a frame buffer <A> 2A. A window 3, which undergoes the double buffering display, is alternately drawn on the frame buffer <A> 2A and a frame buffer <B> 2B. Assume that drawing the windows 1, 2 and 3 on the frame buffer <A> 2A has been completed, the content of the frame buffer <A> 2A is displayed on the monitor 3, and the next CG image for the window 3 is produced and drawn on the frame buffer <B> 2B. In this case, even when the drawing of the window 3 is completed, simple switching of the frame buffers will erase the images of the windows 1 and 2. Actually, it is necessary to copy the image information on the windows 1 and 2 on the frame buffer <A> 2A onto the frame buffer <B> 2B first and then switch the display buffer or the frame buffer whose content is to be displayed.

Unexamined Japanese Patent Publication No. Hei 4-225395, for example, has proposed and disclosed a scheme to realize an efficient window system using such a double buffer system. This system switches display buffers pixel by pixel in accordance with a window identification (ID) plane which is formed on a memory area using a window ID as window ID information.

According to this system, a frame buffer whose content is to be displayed can be selected in accordance with the window ID. Regardless of on which one of double buffers the window that should be switched and displayed quickly as to ensure an animation display or the like is drawn. Therefore, it advantageously becomes unnecessary to copy the image information of the already-drawn window from one buffer to another. In other words, this system permits the conventional window system to be improved to ensure the efficient double buffering display of a CG image.

A window display switching system according to prior art which is substantially equivalent to the technique disclosed in Unexamined Japanese Patent Publication No. Hei 4-225395 will now be described with reference to FIG. 4. This system can efficiently accomplish a multiwindow display on double buffers without performing window copy that has conventionally been needed in the aforementioned switching of the buffers.

More specifically, this system is provided with a window ID information storage 6 for storing a window ID as window ID information to identify a window pixel by pixel as a window ID plane, a buffer select information storage 7 for storing buffer select information indicative of a display buffer for the window ID as, for example, a buffer select table, and a buffer switching section 8 for selectively switching the display buffer pixel by pixel in accordance with the contents of the buffer select table. This structure allows a window one wants to display to be displayed on the screen of the monitor 3 irrespective of whether this window is drawn on the frame buffer <A> 2A or the frame buffer <B> 2B.

In FIG. 4, the content of the frame buffer <A> 2A is displayed for the window 1 and window 2 while the content of the frame buffer <B> 2B is displayed for the window 3. The process of switching the display buffer when the drawing of the window 3 on the frame buffer <A> 2A is completed is accomplished by rewriting the display buffer for the window ID="3" in the buffer select table from "B" to "A."

FIGS. 5 and 6 exemplarily illustrate the process of switching a plurality of images at a high speed, like animation display, using this scheme.

FIG. 6 illustrate the relation between the contents of the frame buffer <A> 2A and frame buffer <B> 2B and the contents of the buffer select table stored in the buffer select information storage 7 in the case where the images of frames n, n+1, . . . , n+m are displayed one after another in the window 3 as the time passes as shown in FIG. 5.

First, the display buffer corresponding to the window ID="1" is "A," the display buffer corresponding to the window ID="2" is "A" and the display buffer corresponding to the window ID="3" is "A," so that all of the window 1, window 2 and window 3 (frame n) are read from the frame buffer <A> 2A and are then displayed. Next, while the display buffers corresponding to the window ID="1" and window ID="2" remain as "A," the display buffer corresponding to the window ID="3" is changed to "B," so that the windows 1 and 2 are read from the frame buffer <A> 2A to be displayed and the window 3 is read from the frame buffer <B> 2B to be displayed. Next, while the display buffers corresponding to the window ID="1" and window ID="2" remain as "A," the display buffer corresponding to the window ID="3" becomes "A" again, so that all of the window 1, window 2 and window 3 (frame n+2) are read from the frame buffer <A> 2A to be displayed.

As apparent from the above, only the display buffer for the window ID="3" is alternately switched between "A" and "B" and the double buffering display is carried out only for the window 3.

With regard to the windows for which no double buffering is executed, however, even the system as disclosed in the aforementioned Unexamined Japanese Patent Publication No. Hei 4-225395 basically performs window display processing, such as saving the window area, which is hidden by another window, into the memory and restoring the window area, which has appeared from behind another window, from the memory, based on the conventional single buffer system.

Although the capacity of the frame buffer is increased by employing the double buffer system, the speed of processing windows which do not involve double buffering is substantially the same as that in the case of the single buffer system.

SUMMARY OF THE INVENTION

Accordingly, it is an objective of the present invention to provide a window display processing method and apparatus which can ensure the effective use of frame buffers and faster window processing in accordance with the number of the frame buffers by executing window processing based on multiple buffers like double buffers, even for windows which are not targeted for multibuffering like double buffering.

A window display processing apparatus according to the first aspect of this invention comprises:

a plurality of frame buffers for storing image information;

a plurality of window ID information storages corresponding to the plurality of frame buffers, for storing window ID information for identifying a window pixel by pixel of each frame buffer;

an overlapping information storage for storing overlapping information describing an overlapping relation among windows over the plurality of frame buffers in association with the frame buffers; and a switching section for selecting a window to be displayed and switching the plurality of frame buffers from one to another pixel by pixel, in accordance with the window ID information and contents of the overlapping information.

This apparatus may further include a rewrite control section for rewriting associated overlapping information while making window ID information of corresponding windows over a plurality of frame buffers common to one another, thereby ensuring fast switching of the corresponding windows.

The overlapping information storage may utilize the symmetry of overlapping information based on the overlapping relation among windows to thereby reduce the amount of the overlapping information.

The apparatus according to the first aspect may further include a rewrite control section which when the overlapping relation among windows is changed due to shifting of windows in front or behind one another (i.e., a change in display priority order), rewrites only overlapping information associated with window ID information of the windows that have changed the overlapping relation.

The apparatus according to the first aspect may further include a converting section for converting a value of a frame buffer selected by the switching section to a value of a pixel to be displayed, based on window ID information corresponding to a window selected to be displayed.

A window display processing method according to the second aspect of this invention comprises:

an image information storing step of storing image information into a plurality of frame buffers, respectively;

an ID information storing step of storing window ID information for identifying a window pixel by pixel of each frame buffer, into a plurality of window ID storages corresponding to the plurality of frame buffers;

an overlapping information storing step of storing overlapping information describing an overlapping relation among windows over the plurality of frame buffers, into an overlapping information storage corresponding to the plurality of frame buffers; and a switching step of selecting a window to be displayed and switching the plurality of frame buffers from one to another pixel by pixel, in accordance with the window ID information and contents of the overlapping information.

This method may further include a rewriting step of rewriting associated overlapping information while making window ID information of corresponding windows over a plurality of frame buffers common to one another, thereby ensuring fast switching of the corresponding windows.

The overlapping information storing step may utilize the symmetry of overlapping information based on the overlapping relation among windows to thereby facilitate the storage of the overlapping information.

The method according to the second aspect may further include a rewrite control step of, when the overlapping relation among windows is changed due to shifting of windows in front or behind one another, rewriting only overlapping information associated with window ID information of the windows that have changed the overlapping relation.

The method according to the second aspect may further include a converting step of converting a value of a frame buffer selected by the switching step to a value of a pixel to be displayed, based on window ID information corresponding to a window selected to be displayed.

The window display processing apparatus according to this invention is provided with the window ID information storages corresponding to a plurality of frame buffers, for storing window ID information for identifying a window pixel by pixel of each frame buffer, and the overlapping information storage for storing overlapping information describing an overlapping relation among windows over the plurality of frame buffers in association with the frame buffers, and causes the switching section for switching the frame buffers from one to another pixel by pixel to select a window to be displayed and to perform the window switching in accordance with the window ID information and the contents of the overlapping information. Even for windows which are not targeted for multibuffering like double buffering, therefore, this system can ensure the effective use of frame buffers and faster window processing in accordance with the number of the frame buffers by executing window processing based on multiple buffers like double buffers.

For example, the window display processing system with a double buffer structure which embodies this invention sets window ID planes each consisting of window ID's corresponding to the associated buffer and an overlapping table which shows the overlapping relation among a plurality of windows, and switches a window to be displayed based on the contents of the overlapping table.

To store different windows distributively at the same location on double buffers, a window ID plane is set for each of the double buffers. The overlapping table which shows the overlapping relation among windows is set to determine which of different windows stored distributively in the individual buffers should be displayed. Since the overlapping table has a symmetric property, the space for storing the elements in the overlapping table can be saved using this property.

As the image information of windows can be stored distributively in a plurality of frame buffers in the system of this invention, the storage space can be used effectively. For windows which are stored distributively in a plurality of frame buffers, saving an overlapping area to a memory and restoring such an overlapping area from the memory should be executed only with respect to the image of any window located in the same frame buffer. This feature can speed up the window processing.

BRIEF DESCRIPTION OF THE DRAWINGS

Other objects and advantages of the invention will become apparent during the following discussion in conjunction with the accompanying drawings, in which:

FIG. 8 is a diagram exemplifying an overlapping table used in the system in FIG. 7;

FIG. 12 is a diagram exemplifying an overlapping table corresponding to the contents of the frame buffers and the display screen in FIG. 11;

FIG. 14 is a diagram exemplifying an overlapping table corresponding to the contents of the frame buffers and the display screen in FIG. 13;

FIG. 16 is a diagram exemplifying an overlapping table corresponding to the contents of the frame buffers and the display screen in FIG. 15.

DETAILED DESCRIPTION OF THE PREFERRED EMBODIMENTS

Window display processing apparatuses according to preferred embodiments of the present invention will now be described with reference to the accompanying drawings.

First Embodiment

Figure 7:
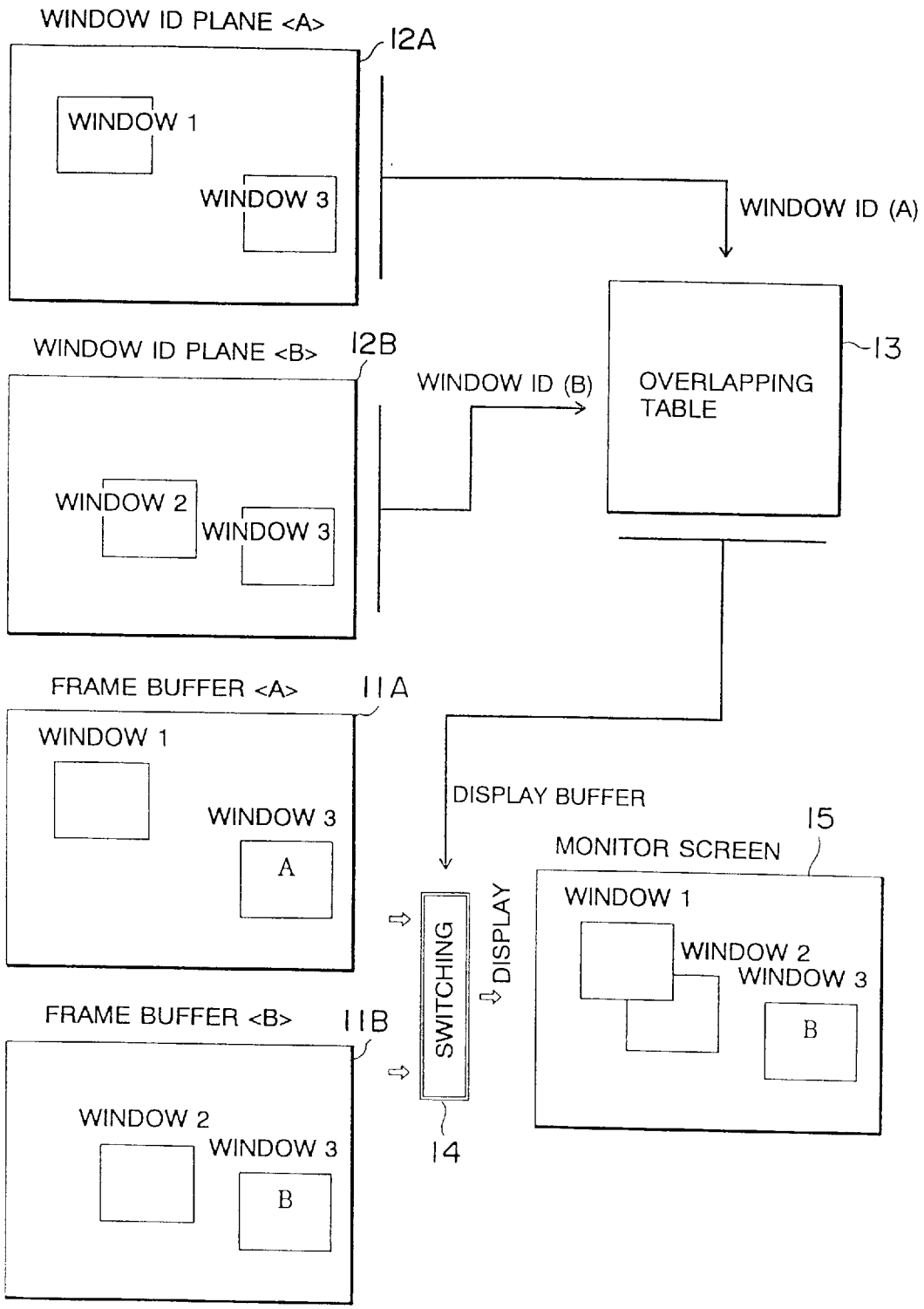
FIG. 7 is a block diagram exemplarily showing the structure of a principle system according to a first embodiment of this invention as applied to a window display processing apparatus.

FIG. 7 exemplarily illustrates the structure of a principle window display processing system according to the first embodiment of this invention. The system in FIG. 7 is designed as a double buffer system having a pair of frame buffers. This system comprises a frame buffer <A> 11A, a frame buffer <B> 11B, a window ID plane storage <A> 12A, a window ID plane storage <B> 12B, an overlapping table storage 13, a switching section 14 and a monitor 15.

The frame buffer <A> 11A and frame buffer <B> 11B store image information.

The window ID plane storage <A> 12A and window ID plane storage <B> 12B respectively correspond to the frame buffer <A> 11A and frame buffer <B> 11B, and respectively store window ID planes A and B which are image tables each consisting of window ID information for each pixel for identifying a window of interest pixel by pixel of each frame buffer (frame buffer <A> 11A or frame buffer <B> 11B). In other words, those window ID planes A and B respectively correspond to the frame buffer <A> 11A and frame buffer <B> 11B, and the individual pixels of the window ID planes A and B respectively correspond to the individual pixels of the frame buffer <A> 11A and frame buffer <B> 11B.

The overlapping table storage 13, which corresponds to the frame buffer <A> 11A and frame buffer <B> 11B, stores an overlapping table which consists of overlapping information that describes the overlapping relation among individual windows over those frame buffers. The switching section 14 selects a window to be displayed, in accordance with the aforementioned window ID planes A and B and the contents of the overlapping table, and switches between the frame buffer <A> 11A and frame buffer <B> 11B pixel by pixel.

The monitor 15 displays the contents of the frame buffer <A> 11A or frame buffer <B> 11B, selected pixel by pixel by the switching section 14, on its screen.

According to the system of this invention, a plurality of window ID planes and the overlapping table showing the overlapping relation among windows are provided in the multiple frame buffer structure, and windows to be displayed are switched from one to another based on the window ID planes and the contents of the overlapping table.

For easier understanding of this invention, FIG. 7 illustrates a double buffer structure.

Figure 1:
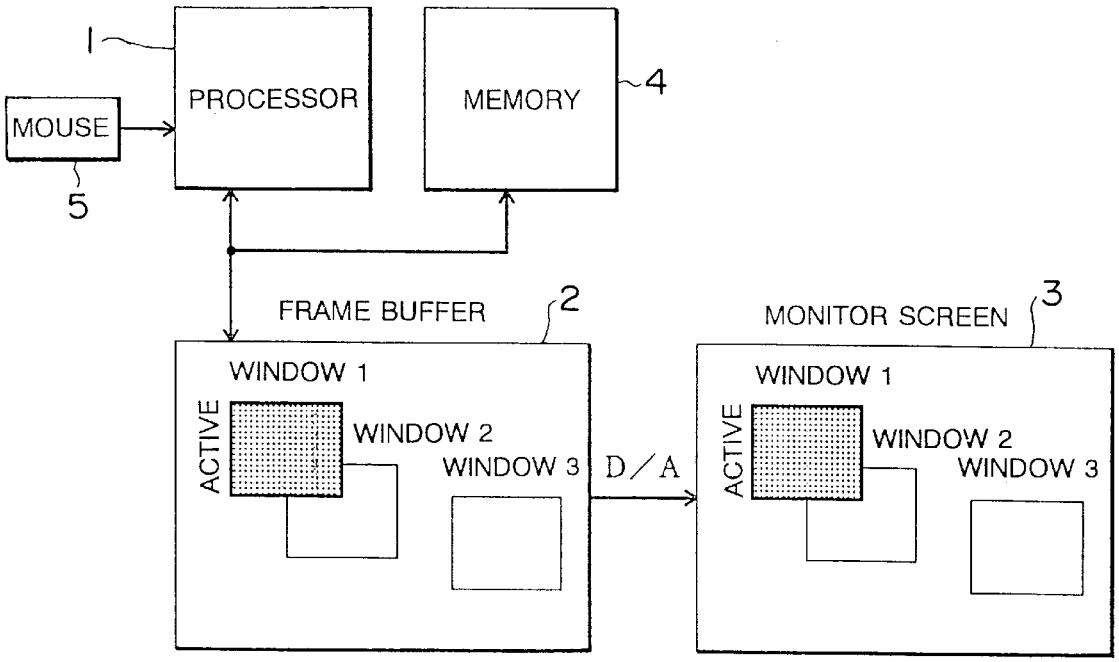
FIG. 1 (PRIOR ART)
FIG. 1 is a block diagram exemplarily showing the structure of one example of a window display processing apparatus in a conventional window system.
Figure 2:
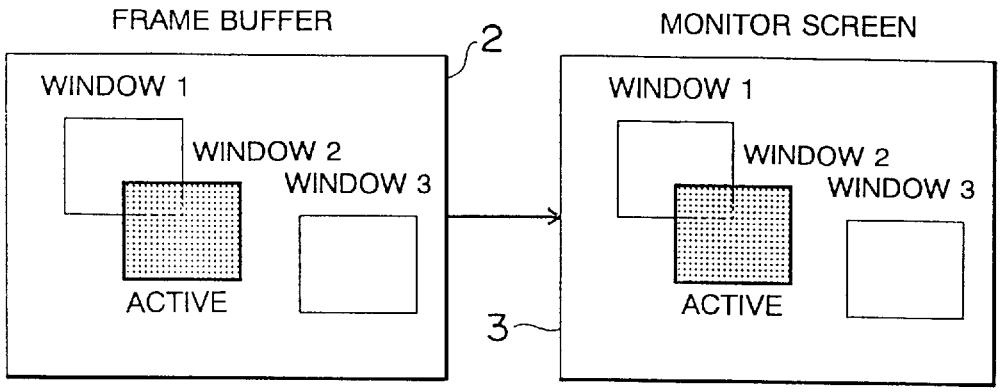
FIG. 2 (PRIOR ART)
FIG. 2 is an exemplary diagram for explaining another example of the relation between the content of a frame buffer and the display screen in the system in FIG. 1.
Figure 3:
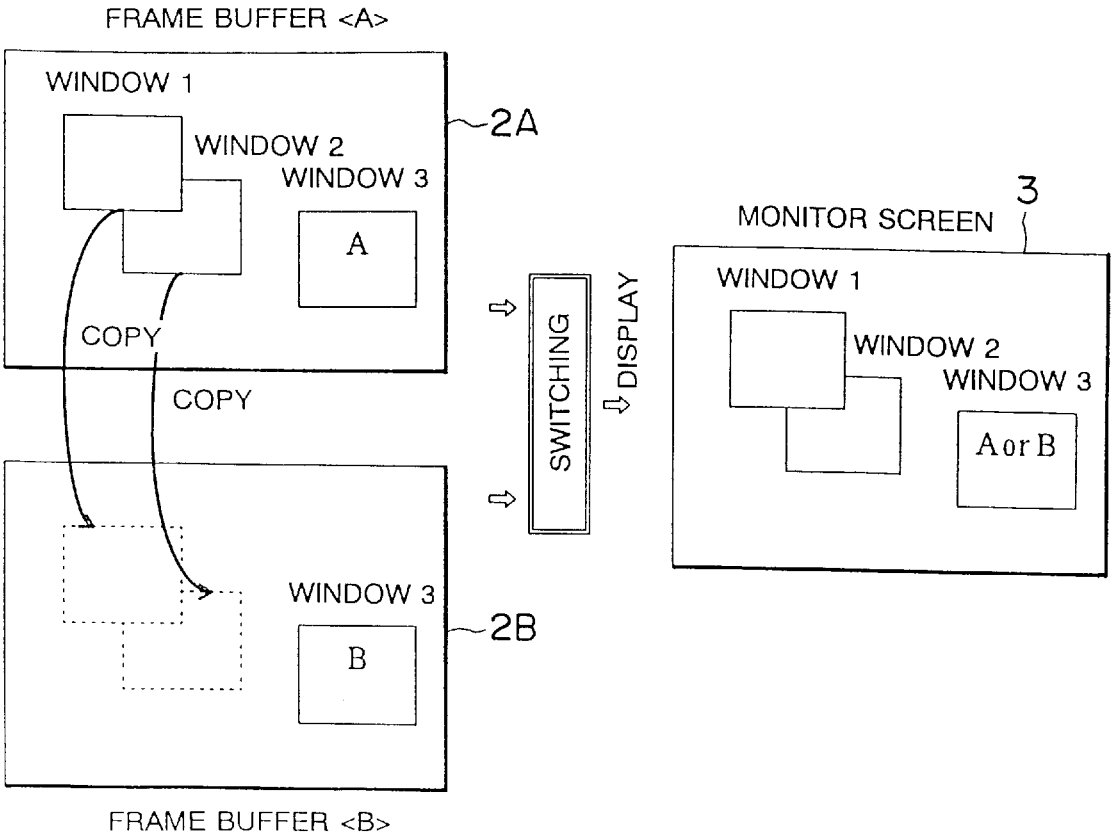
FIG. 3 (PRIOR ART)
FIG. 3 is a block diagram exemplarily showing the structure of one example of a window display processing apparatus of an ordinary conventional double buffer system.
Figure 4:
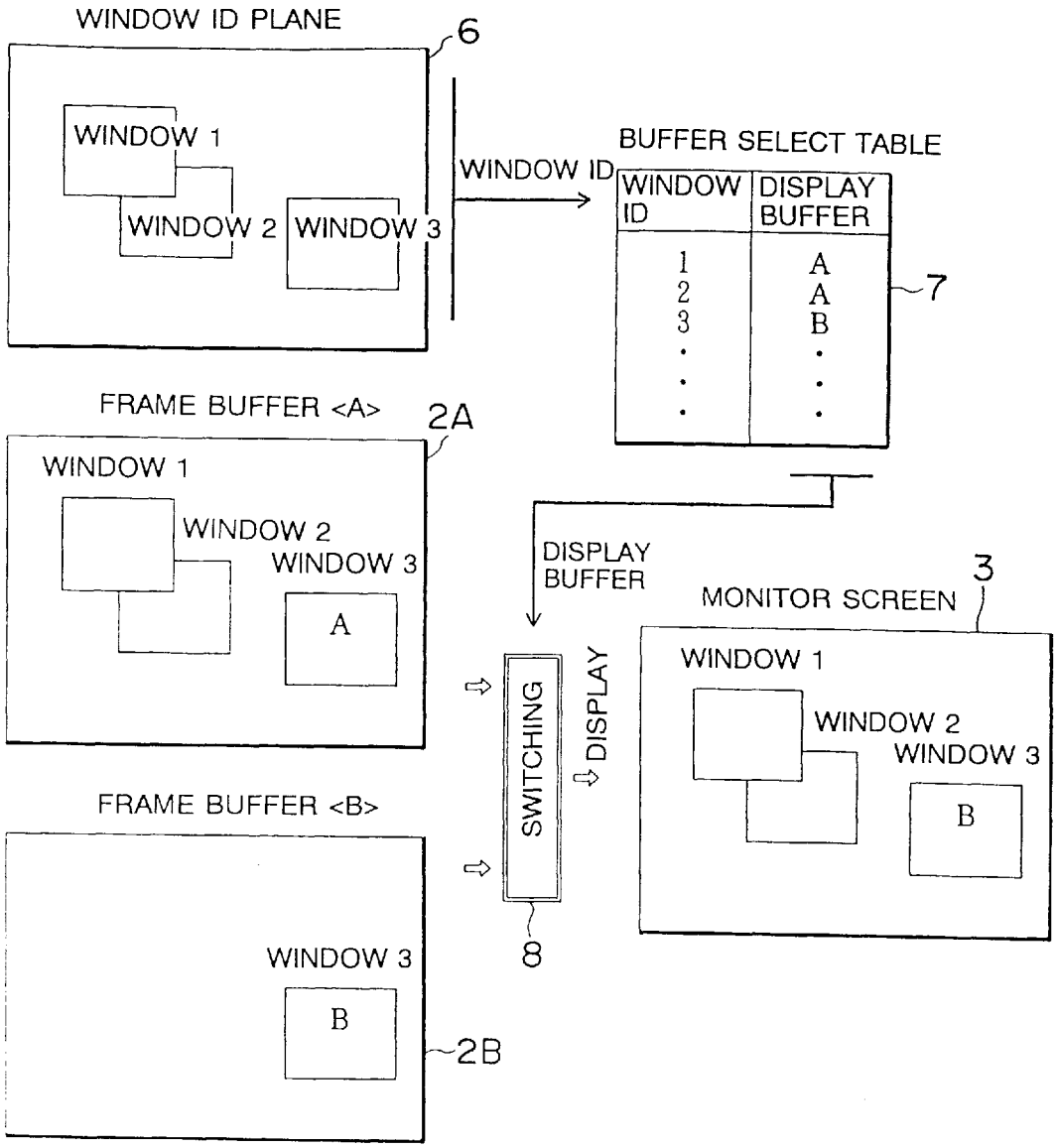
FIG. 4 (PRIOR ART)
FIG. 4 is a block diagram exemplarily showing the structure of another example of the window display processing apparatus of the conventional double buffer system.
Figure 5:
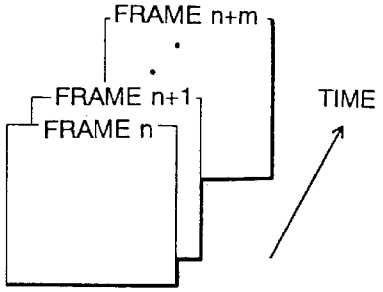
FIG. 5 (PRIOR ART)
FIG. 5 is an exemplary diagram for explaining the operation of the system in FIG. 4.
Figure 6:
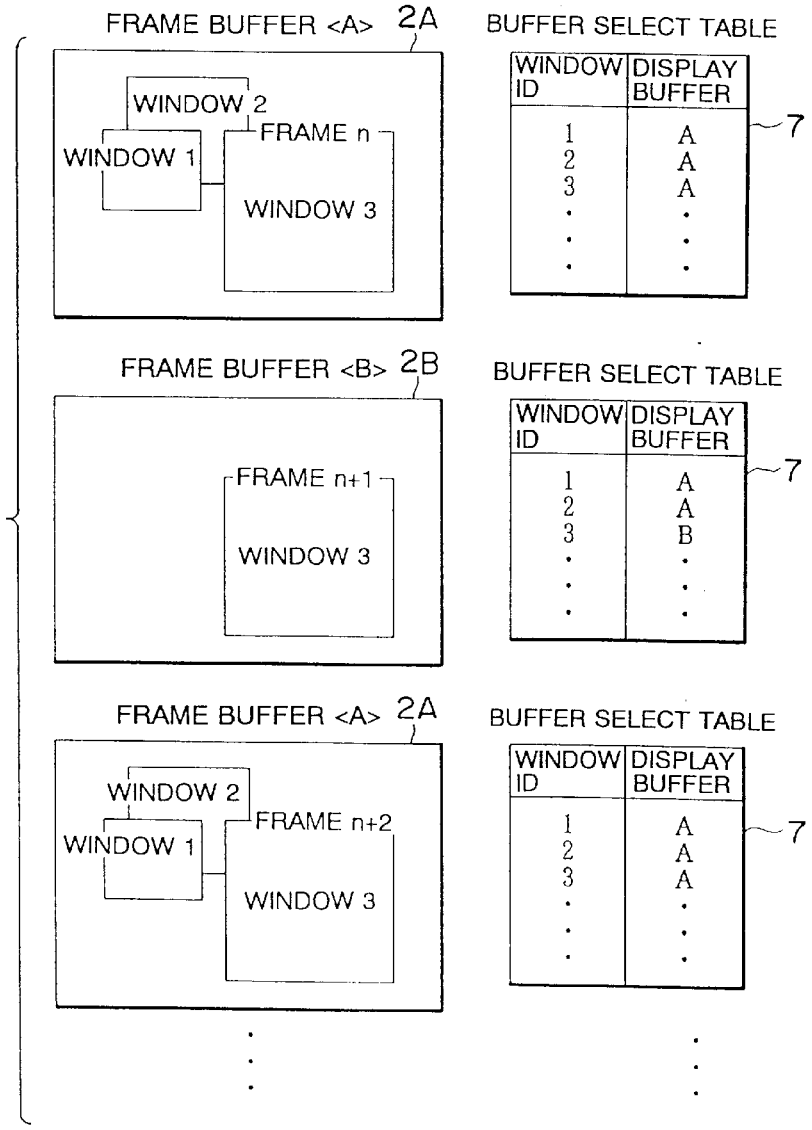
FIG. 6 (PRIOR ART)
FIG. 6 is an exemplary diagram for explaining the operation of the system in FIG. 4.

In the above-described conventional system, since a window is specifically determined if the window positions on the double buffers are the same, a window ID plane for one frame is sufficient as apparent from FIG. 4. However, information of different windows are distributively stored at the same location on the double buffers, raising the aforementioned problem.

To avoid the problem, the system in FIG. 7 is provided with the window ID plane <A> and window ID plane <B> in association with the frame buffer <A> 11A and frame buffer <B> 11B, which constitute the double buffer structure.

In the conventional system, a buffer select table is prepared to determine which buffer's content should be displayed for the window ID that has been retrieved from the window ID plane, and it is specifically determined which buffer's content for which window should be displayed.

In contrast to the conventional system, the system in FIG. 7 is further provided with the overlapping table which shows the overlapping relation among windows to determine which one of different windows distributively stored in the frame buffer <A> 11A and frame buffer <B> 11B.

FIG. 8 shows one example of the overlapping table stored in the overlapping table storage 13. As shown in FIG. 8, the overlapping table is designed in a two-dimensional matrix. The row index in the two-dimensional matrix of the overlapping table, the window ID <A>, indicates the value of the window ID plane <A> which is stored in the window ID plane storage <A> 12A, and the column index in the two-dimensional matrix, the window ID <B>, indicates the value of the window ID plane <B> which is stored in the window ID plane storage <B> 12B.

In FIG. 8, the matrix element being "A" indicates that the window ID <A> hides the window ID <B> and means that the frame buffer <A> 11A should be displayed. The matrix element being "B" indicates that the window ID <B> hides the window ID <A> and means that the frame buffer <B> 11B should be displayed. For an area where no window is present, the content of whichever buffer may be displayed so that the matrix element for this area is indicated as "X." With regard to an area where no data is present or the background area, the window ID is set to "0."

For each window based on the window ID planes A and B, the switching section 14 selects either the frame buffer <A> 11A or the frame buffer <B> 11B pixel by pixel in accordance with the matrix elements in the overlapping table and supplies the content of the selected frame buffer to the monitor 15 to display it.

A description will now be given of the case where windows are stored in the frame buffer <A> 11A and frame buffer <B> 11B as shown in FIG. 7. In this case, a window 1 is stored only in the frame buffer <A> 11A, a window 2 is stored only in the frame buffer <B> 11B, and a window 3 is stored in both the frame buffers <A> 11A and <B> 11B. The window 1 is located in front of the window 2. With regard to the window 3, the frame buffer <B> 11B is located in front of the frame buffer <A> 11A.

Therefore, the element at the window ID <A>=1 (first row) and the window ID <B>=2 (second column) becomes "A," and for the portion where the window 1 and window 2 overlap each other, the window 1 of the frame buffer <A> 11A is displayed. The element at the window ID <A>= window ID <B>=3 (third row and third column) becomes "B," and for the window 3, the window 3 of the frame buffer <B> 11B is displayed.

The display buffer for the window 3 can be switched to the frame buffer <A> 11A from the frame buffer <B> 11B by setting the element at the window ID <A>=window ID <B>=3 to "A," considering that the frame buffer <A> 11A is in front of the frame buffer <B> 11B. By changing the matrix element in this manner, while the content of the frame buffer <B> 11B has been displayed originally for the window 3, the content of the frame buffer <A> 11A will be displayed next.

If the overlapping table is described as $M=(m_{ij})$ where $m_{ij}$=A, B, the following relation is given.

For $i \neq j$, when $m_{ji}$=A, $m_{ij}$=B, and when $m_{ji}$=B, $m_{ij}$=A.

Since a part of the overlapping table is specifically determined by data of another part, it is possible to save the memory space for storing the elements of the overlapping table using this property.

This system can switch the display content of the same window merely by switching the frame buffer to be displayed for the same window which is distributively stored in a plurality of frame buffers. This system can therefore serve as ordinary double buffers for such a window, thus ensuring fast switching of the display content.

Because a window can be distributively stored in multiple buffers or a plurality of frame buffers, the memory space can be used effectively. Further, for a window which is stored distributively in a plurality of frame buffers, saving the overlapping area to the memory and restoring such an overlapping area from the memory should be executed only with respect to a plurality of windows in the same frame buffer. This feature can increase the speed of the window processing.

Second Embodiment

Figure 9:
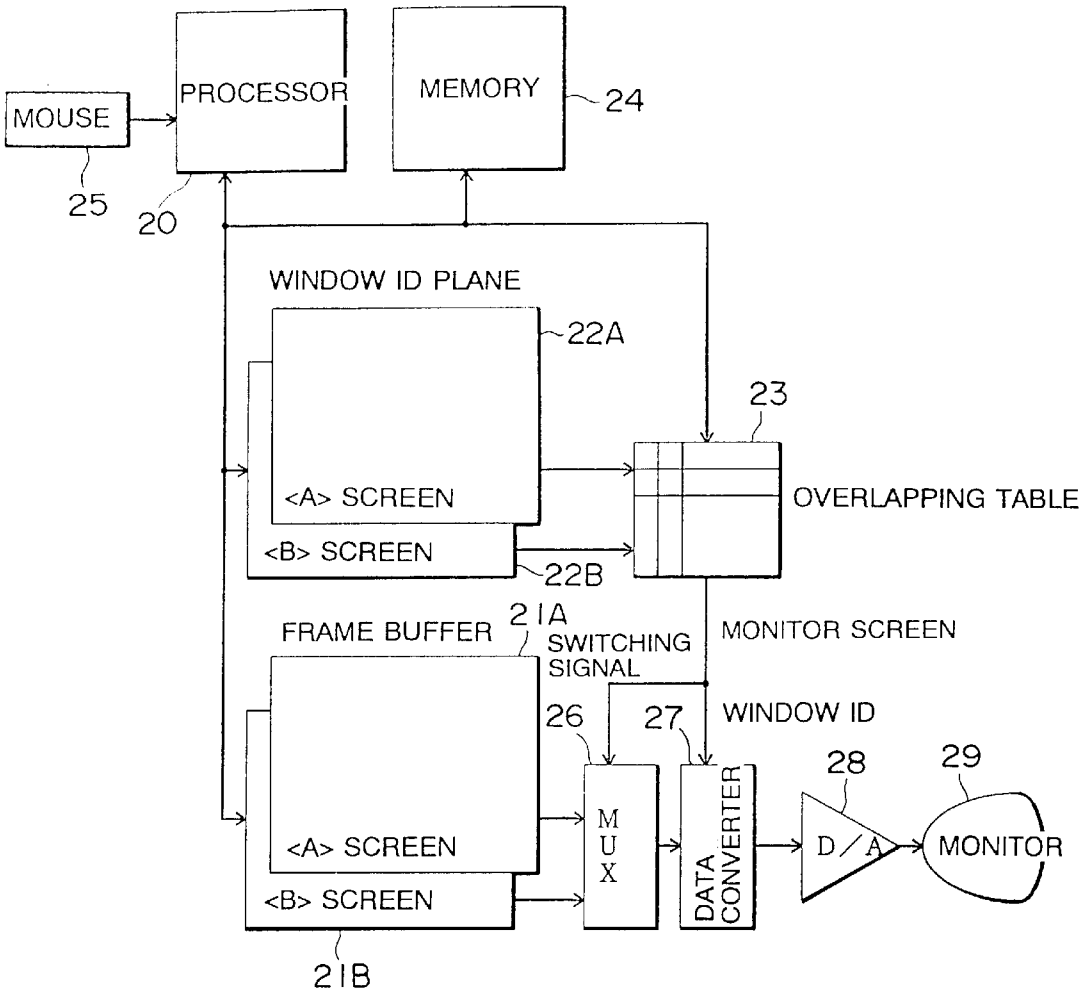
FIG. 9 is a block diagram exemplarily showing the structure of a specific system according to a second embodiment of this invention as applied to a window display processing apparatus.

FIG. 9 shows the structure of a window display processing system according to the second embodiment of this invention. The system in FIG. 9 is designed more specifically than the system in FIG. 7.

The system in FIG. 9 comprises a processor 20, a frame buffer <A> 21A, a frame buffer <B> 21B, a window ID plane storage <A> 22A, a window ID plane storage 22B, an overlapping table storage 23, a memory 24, a mouse 25, a multiplexer (MUX) 26, a data converter 27, a D/A (Digital-to-Analog) converter 28 and a monitor 29. This system, like the system in FIG. 7, is designed as a double buffer system having a pair of frame buffers. The memory 24 is a main memory.

The window ID plane storage <A> 22A and window ID plane storage <B> 22B respectively store window ID planes A and B which consist of associated window ID's pixel by pixel and which respectively correspond to the frame buffer <A> 21A and frame buffer <B> 21B.

The overlapping table storage 23 stores an overlapping table, which is a matrix table that associates the overlapping relation of individual windows over the frame buffer <A> 21A and frame buffer <B> 21B with the individual window ID's in the window ID planes A and B.

The multiplexer 26 selectively switch the frame buffer to be displayed, in accordance with the overlapping table in the overlapping table storage 23. The data converter 27 converts a data value obtained from the frame buffer <A> 21A or the frame buffer <B> 21B to the attribute of the associated window. The D/A converter 28 converts a digital signal to an analog signal, which is in turn supplied to the monitor 29 to be displayed.

Figure 10:
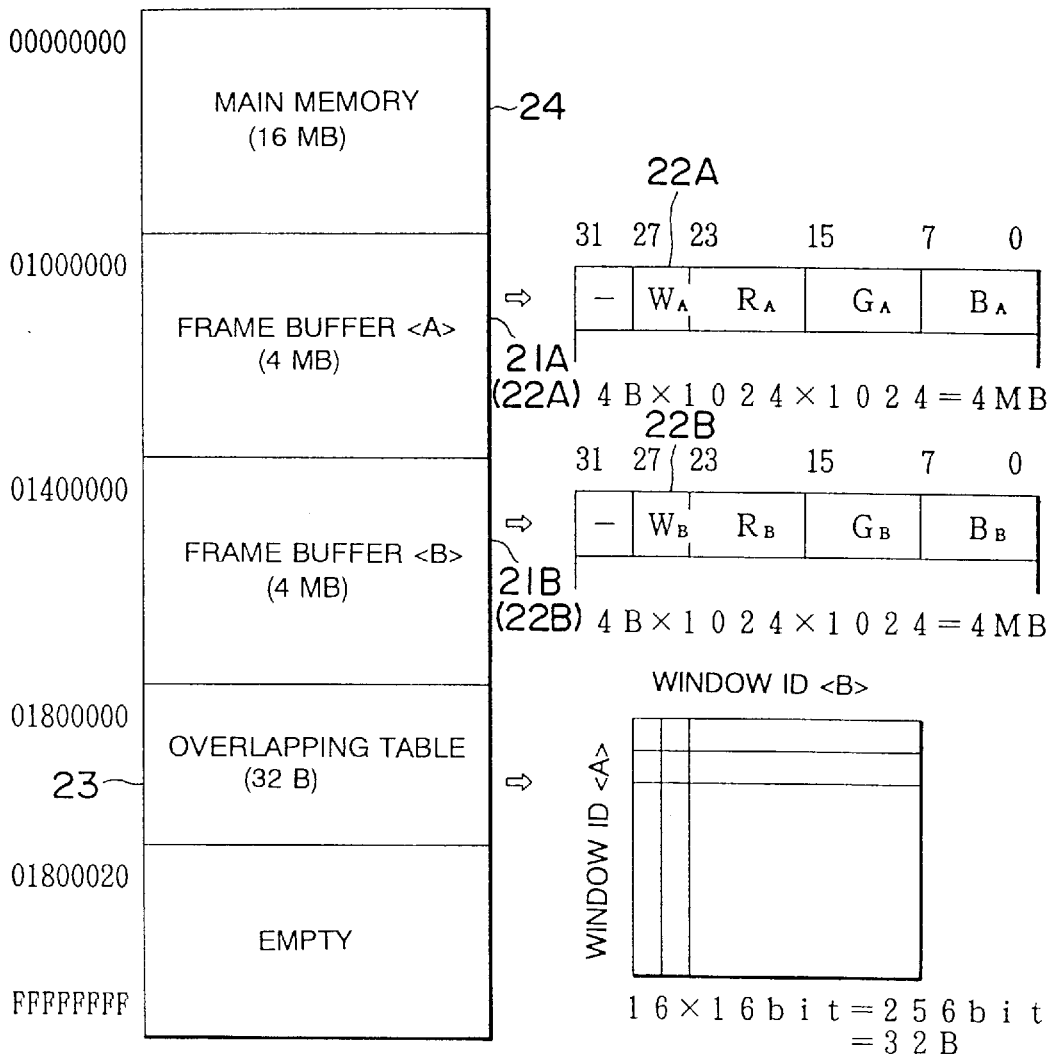
FIG. 10 is a diagram showing a specific example of a memory map in the system in FIG. 9.

FIG. 10 shows one example of memory mapping in the system in FIG. 9. More specifically, FIG. 10 illustrate how various resources such as the frame buffers in FIG. 9 are mapped in the memory space in the processor.

Each pixel of the frame buffer <A> 21A and frame buffer <B> 21B is expressed in a packed pixel form which consists of 4-bit data W ($W_A$ and $W_B$) indicative of a window ID and 8-bit data R, G and B ($R_A$, $G_A$ and $B_A$ and $R_B$, $G_B$ and $B_B$) showing the colors R, G and B of the pixel. Therefore, the window ID planes A and B are respectively incorporated in the frame buffer <A> 21A and frame buffer <B> 21B, so that the frame buffer <A> 21A and the frame buffer <B> 21B are integrated with the window ID plane storage <A> 22A and the window ID plane storage <B> 22B on the memory map. In this case, each frame buffer has a size of 1024×1024 pixels.

The overlapping table defines a switch signal to the multiplexer 26 and provides a window ID to be displayed to the data converter 27. This overlapping table is designed to be a two-dimensional matrix of $2^4 \times 2^4$ or 16×16 in association with 4-bit window ID's. More specifically, the elements of the overlapping table take a value of "1" or "0" in association with 256 combinations of the window ID <A> and window ID <B>. When an element of the overlapping table is "1," the content of the frame buffer <A> 21A is selected and is output from the multiplexer 26, while when an element of the overlapping table is "0," the content of the frame buffer <B> 21B is selected and is output from the multiplexer 26.

Given that the overlapping table is described as $M=(m_{ij})$ and $m_{ij}=0, 1$, then $m_{ji}=NOT(m_{ij})$ and $i \neq j$ because of the overlapping relation. A value output from the multiplexer 26 is subjected to data conversion in the data converter 27 in accordance with the attribute of the associated window. For instance, the data converter 27 has a table indicating whether index values or RGB values are stored in the frame buffers <A> 21A and <B> 21B. When the selected window is expressed by an index value, this index value is converted to an RGB value by referring to the previously set table.

FIGS. 11 to 16 illustrate examples of the window processing which is executed by the system of this embodiment shown in FIG. 9.

Figure 11:
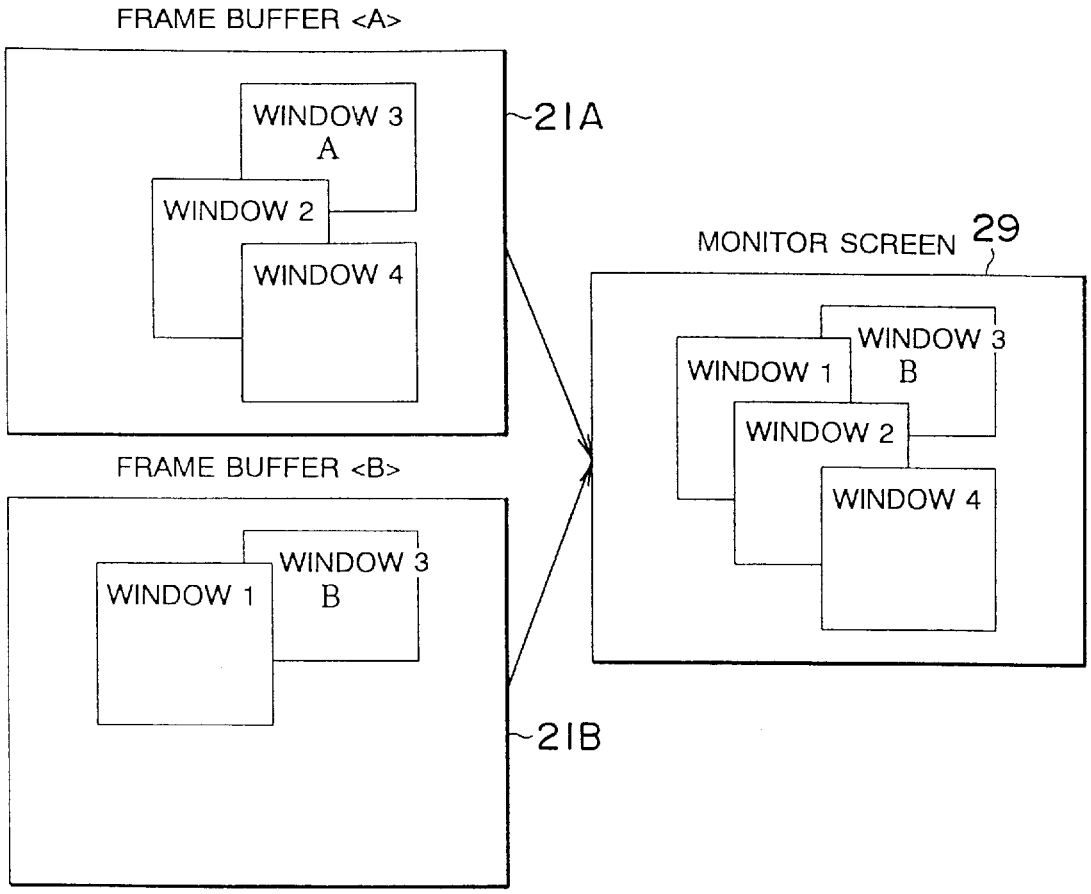
FIG. 11 is an exemplary diagram for explaining a first example of the relation between the contents of frame buffers and the display screen in the system in FIG. 9.

In FIG. 11, four windows 1 to 4 are opened and have such an overlapping relation that the window 4 comes to the topmost position, and the windows 2, 1 and 3 come behind the window 4 in the named order. The windows 4, 2 and 3 are drawn on the frame buffer <A> 21A, while the windows 1 and 3 are drawn on the frame buffer <B> 21B. The window 3 is drawn on both the frame buffer <A> 21A and frame buffer <B> 21B to ensure a fast switched display like an animation display. Setting the overlapping table as shown in FIG. 12 allows the multiplexer 26 to properly select the window and frame buffer to be displayed.

In the overlapping table shown in FIG. 12, for the window ID <A>=4 (fourth row), the elements on the window ID <B>=1, 2 and 3 (first, second and third columns) are all "1" which apparently indicates that the frame buffer <A> has been selected. As the window 4 is at the topmost position, the content of the frame buffer <A> 21A is displayed with priority, regardless of whichever window is present in the frame buffer <B> 21B. The values on the diagonal line of the overlapping table indicate which buffer's content should be displayed in the window that involves the double buffers like the window 3. In this example, the value at the window ID <A>=window ID <B>=3 (third row and third column) is set to "0" to display the content of the frame buffer <B>. The window ID=0 indicates the background area where no window is present, and when an element corresponding to the other window ID=0 is "0," this element becomes "1" regardless of which of "1" to "15" the window ID takes and the content of the buffer where that window is present is displayed.

Figure 13:
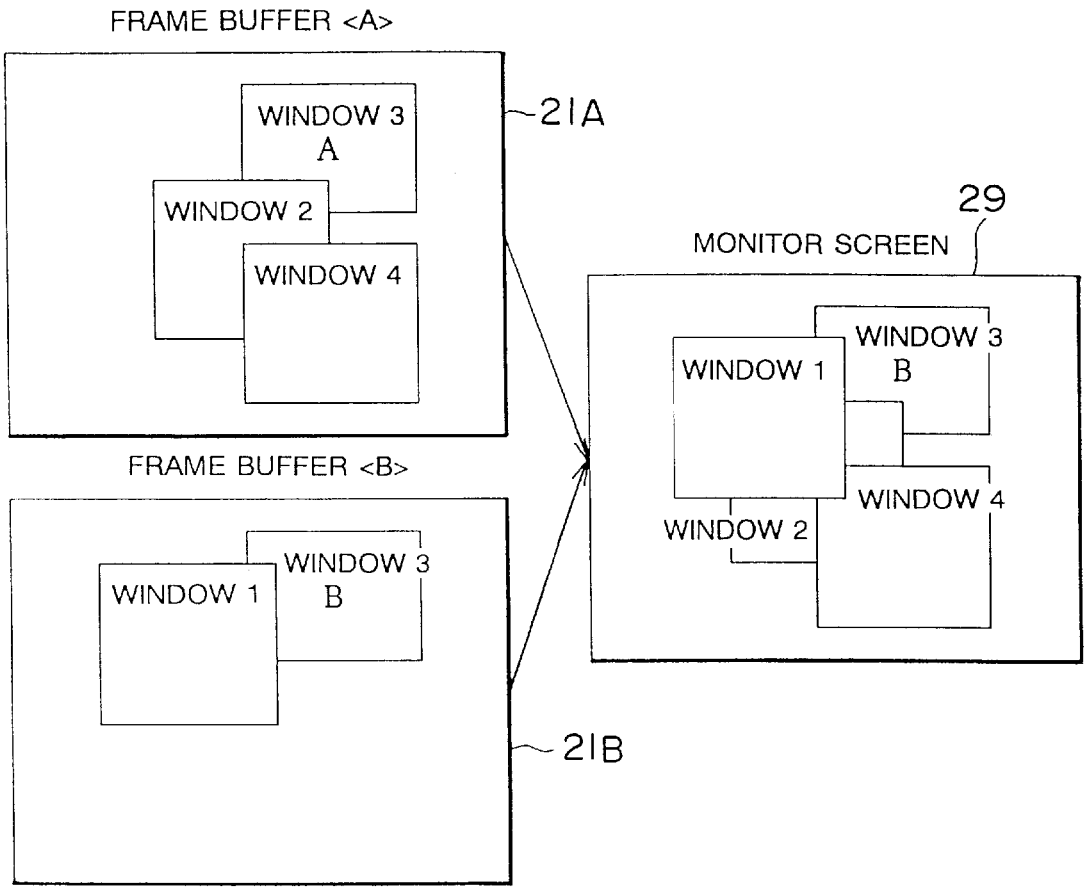
FIG. 13 is an exemplary diagram for explaining a second example of the relation between the contents of frame buffers and the display screen in the system in FIG. 9.

FIG. 13 shows an example in which the windows' overlapping relation is different from the one shown in FIG. 11.

FIG. 13 shows that the window 1, which is hidden behind the window 2 in FIG. 11, comes to the top. In this case, the front and behind relation between the windows 1 and 2 and the front and behind relation between the windows 1 and 4 change.

Accordingly, the value of the element at the window ID <B>=1 and window ID <A>=2 changes to "0" from "1" and the value of the element at the window ID <B>=1 and window ID <A>=4 changes to "0" from "1." Because of the characteristic of the overlapping table, the values of the elements at symmetrical positions (inverted position) to the above positions, i.e., the values of the elements at the window ID <A>=1 and window ID <B>=2 and at the window ID <A>=1 and window ID <B>=4 change to "1" from "0." When the front and behind relation of the window 1 is changed, the switching of the frame buffer to be displayed can be accomplished by rewriting only the element at the row and column associated with the window 1 in the overlapping table. Because of the characteristic of the overlapping table, it is apparent that the values of the elements above the diagonal line are the inverted values of the symmetrical elements below the diagonal line with respect to this line. When the value of any element above the diagonal line is rewritten, the value of the associated symmetrical element below the diagonal line should be rewritten with the inverted value of the changed value. The overlapping table can therefore be rewritten by rewriting either the row or column of the window which has come to the front or behind another window and has changed its overlapping relation. The overlapping table may have only the elements below or above the diagonal line in order to reduce the capacity of the overlapping table.

Figure 15:
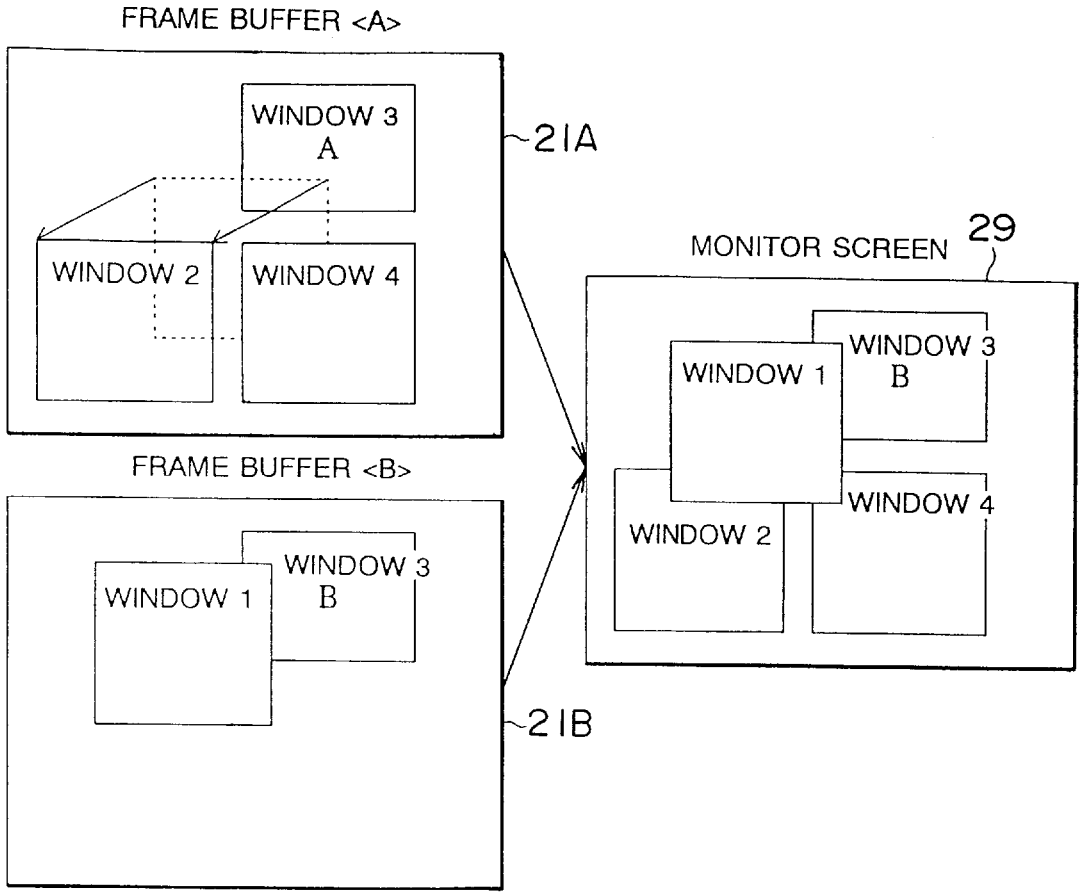
FIG. 15 is an exemplary diagram for explaining a third example of the relation between the contents of frame buffers and the display screen in the system in FIG. 9.

FIG. 15 shows an example where the positional relation among the windows is further changed. In FIG. 15, the window 2 in FIG. 13 makes a parallel shift toward the lower left of the screen. As the window 2 present in the frame buffer <A> 21A is moved, the portion which is not influenced by the window 1 that is located only in the other frame buffer, i.e., the partial area of the window 2 which has been hidden by the window 4 before the movement of the window 2 surfaces. This movement of the window 2 also allows the partial area of the window 3 which has been hidden by the window 2 to surface. Since the overlapping relation has not changed, the overlapping table in the case illustrated in FIG. 16 remain unchanged from the one shown in FIG. 14. Consequently, the display buffer is properly selected and the windows are displayed on the monitor screen as shown in FIG. 15.

Even when a window present in one buffer is shifted, this movement does not affect a window present in the other buffer, thus accomplishing fast window processing.

It is apparent that, in this invention, a wide range of different working modes can be formed based on the invention without deviating from the spirit and scope of the invention.

What is claimed is:

1. A window display processing apparatus for displaying a plurality of windows comprising:

a plurality of frame buffers each for storing image information regarding at least one window to be displayed on a monitor;

a plurality of window ID information storages, each corresponding to one of said plurality of frame buffers, each window ID information storage storing, pixel by pixel, window ID information identifying the corresponding at least one window for each pixel in the corresponding frame buffer;

an overlapping table for storing overlapping information representing an overlapping relation among windows as between said plurality of frame buffers, the overlapping information being cross-indexed by the windows in each of said window ID information storages to indicate a window to be displayed when windows overlap as between windows in different frame buffers; and switching means for selecting, pixel by pixel, a frame buffer from which a pixel is transmitted to the monitor from among said plurality of frame buffers in accordance with the window ID information and the overlapping information.

2. The apparatus according to claim 1, further including rewrite control means for rewriting associated overlapping information while making window ID information of corresponding windows over a plurality of frame buffers common to one another, ensuring fast switching of said corresponding windows.

3. The apparatus according to claim 1, wherein said overlapping information storage means utilizes symmetry of overlapping information based on said overlapping relation among windows to thereby reduce an amount of said overlapping information.

4. The apparatus according to claim 1, further including rewrite control means for, when said overlapping relation among windows is changed due to shifting of windows in front or behind one another, rewriting only overlapping information associated with window ID information of said windows that have changed said overlapping relation.

5. The apparatus according to claim 1, further including converting means for converting a value of a frame buffer selected by said switching means to a value of a pixel to be displayed, based on window ID information corresponding to a window selected to be displayed.

6. A window display processing method for displaying a plurality of windows comprising:

storing image information regarding a plurality of windows to be displayed on a monitor across a plurality of frame buffers;

storing window ID information on a pixel by pixel basis, identifying a window of each pixel in a corresponding frame buffer, into a plurality of window ID storages corresponding to said plurality of frame buffers;

storing overlapping information, representing an overlapping relation among windows over the plurality of frame buffers, the overlapping information being cross-indexed by the windows in each of said window ID information storages to indicate a window to be displayed when windows overlap as between windows in different frame buffers; and selecting, pixel by pixel, a frame buffer from which a pixel is transmitted to the monitor from among said plurality of frame buffers in accordance with the window ID information and the overlapping information.

7. The method according to claim 6, further including a step of:

rewriting associated overlapping information while making window ID information of corresponding windows over a plurality of frame buffers common to one another, thereby ensuring fast switching of said corresponding windows.

8. The method according to claim 6, where the storing of overlapping information utilizes symmetry of overlapping information based on said overlapping relation among windows to facilitate storage of the overlapping information.

9. The method according to claim 6, further including a step of:

when the overlapping relation among windows is changed due to shifting of windows in front or behind one another, rewriting only overlapping information associated with window ID information of said windows that have changed said overlapping relation.

10. The method according to claim 6, further including a step of:

converting a value of a frame buffer selected when selecting a window to a value of a pixel to be displayed, based on window ID information corresponding to the window selected to be displayed.

* * * * *